United States Patent [19]

Wissinger

[11] 4,437,712

[45] Mar. 20, 1984

[54] CABINET SYSTEM

[76] Inventor: John W. Wissinger, 239 Mitchell Rd., New Castle, Pa. 16105

[21] Appl. No.: 281,543

[22] Filed: Jul. 9, 1981

[51] Int. Cl.[3] ..... A47B 67/02

[52] U.S. Cl. ..... 312/246; 312/209

[58] Field of Search ..... 248/224.3, 224.4, 225.2, 248/338, DIG. 11; 211/2, 88; 312/111, 209, 245, 246, 247, 324

[56] References Cited

U.S. PATENT DOCUMENTS

| | | | |
|---|---|---|---|
| 944,580 | 12/1909 | Sargent | 312/329 |
| 1,751,107 | 3/1930 | Smith | 49/76 |
| 1,793,081 | 2/1931 | Goddard | 49/382 |
| 2,206,664 | 7/1940 | Davis | 312/209 X |
| 2,450,337 | 9/1948 | Hearst | 312/245 X |
| 2,605,869 | 8/1952 | Backman | 52/770 |
| 2,642,331 | 6/1953 | Sprinkle | 312/206 |
| 2,678,252 | 5/1954 | Swearingen | 312/223 |
| 2,927,198 | 3/1960 | Trott | 362/128 |
| 3,004,815 | 10/1961 | Okain et al. | 312/242 |
| 3,008,785 | 11/1961 | Gehrs | 312/209 |
| 3,038,771 | 6/1962 | Schwartz et al. | 312/223 |
| 3,117,353 | 1/1964 | Edwards | 248/225.2 X |
| 3,167,370 | 1/1965 | Mancini | 312/209 |
| 3,274,735 | 9/1966 | Stackhouse | 318/332 |
| 3,287,856 | 11/1966 | Passovoy | 52/136 |
| 3,298,764 | 1/1967 | Goldfarb | 312/204 |
| 3,301,602 | 1/1967 | Dasovic et al. | 299/64 |
| 3,488,955 | 8/1969 | Brooks | 74/96 |
| 3,563,264 | 2/1971 | Stice | 312/198 X |
| 3,754,806 | 8/1973 | Nakagawa | 312/257 |
| 3,774,345 | 11/1973 | Cole et al. | 49/399 |
| 3,780,281 | 12/1973 | Ohlhauser et al. | 312/223 |
| 3,925,934 | 12/1975 | Burgers | 49/504 |
| 4,023,872 | 5/1977 | Palka et al. | 312/226 |
| 4,042,287 | 8/1977 | Hallen | 312/209 |
| 4,134,625 | 1/1979 | Palka | 312/206 |
| 4,154,356 | 5/1979 | Schieve | 211/88 X |
| 4,279,397 | 7/1981 | Larsson | 312/245 X |

FOREIGN PATENT DOCUMENTS

| | | | |
|---|---|---|---|
| 1480732 | 6/1973 | United Kingdom | 312/245 |

OTHER PUBLICATIONS

Sears Owners Manual for bathroom medicine cabinet Model number 875.380130 and 875.380150.

Sears Owners Manual for bathroom cabinet Model numbers 875.380250, 855.380330, and 875.380350.

*Primary Examiner*—James T. McCall

*Assistant Examiner*—Joseph Falk

[57] ABSTRACT

A wall mounted cabinet system is disclosed having a mounting bracket adapted to be secured to a wall. The mounting bracket is adapted to support one or more cabinet units in either of two distinct orientations and, in particular, the cabinet units and mounting bracket have complementarily engagable hangers to accomplish this objective. With this arrangement, the cabinet units can be supported by the hangers in a modular array.

14 Claims, 8 Drawing Figures

22
12
22a
20
16
16b
16a
22b
10
40
42
18
14b
14a
14

CABINET SYSTEM

BACKGROUND OF THE INVENTION

The present invention relates to cabinet systems and, more particularly, cabinet systems comprised of one or more wall mounted units capable of being disposed in a modular array.

In the past, cabinets suited for mounting on a wall have lacked the desired degree of versatility. Such cabinets, particularly of the type generally designed for use as medicine cabinets, have conventionally been adapted for mounting in only a single orientation dictated entirely by the design of the cabinet and the structural features thereof. Among other things, this has restricted the ability of the builder or consumer installing a medicine cabinet to select the side from which the hinged door would open and close.

Since it is oftentimes the case that medicine cabinets are mounted on a wall at or near an intersecting wall, this inherent limitation has made it necessary for manufacturers to provide both right and left-hand hinged doors. This has unnecessarily increased manufacturing costs and, moreover, it has made it necessary for distributors and sales outlets to maintain duplicate stock in order to satisfy the needs of all consumers. Because of the obvious advantage to limiting inventory, the need to maintain duplicate stock in medicine cabinets differing only in the side from which the hinged door opens and closes is considered particularly objectionable.

Despite these clear disadvantages, even more significant shortcomings exist. These shortcomings have developed primarily because of the dramatic growth in the use of double-sink vanities. The use of vanities of this type, together with a generally increasing focus on interior design in the bathroom and elsewhere in the home, has made it highly desirable to provide expansive wall mirror areas and, moreover, it is always desirable to increase storage space particularly for articles typically found in medicine cabinets and the like. These factors have suggested the desirability of utilizing a plurality of cabinets in a modular array. However, conventional medicine cabinets have not been suitable for this purpose.

Accordingly, it is an object of the present invention to provide a cabinet system adapted to be mounted on a wall in a modular array.

It is another object of the present invention to provide a cabinet system of the type described which utilizes a single type of cabinet unit in order to reduce manufacturing costs and unnecessary duplication of stock.

Still another object of the present invention is to provide a cabinet system of the type described which utilizes a mounting bracket operable to support the cabinet units in either of two distinct orientations.

It is a further object of the present invention to provide a cabinet system of the type described wherein the mounting bracket and cabinet units include complementarily engagable hanger means for supporting the cabinet units in a modular array.

These and other objects, features and advantages of the present invention will become apparent from the description when considered in connection with the accompanying drawings.

SUMMARY OF THE INVENTION

In general, the objects and advantages of the present invention are met by providing an entirely new type of wall mounted cabinet system. The cabinet system includes one or more cabinet units together with novel means for mounting the cabinet units on a wall. Moreover, the mounting means is operable to support the cabinet units in either of two distinct orientations.

In a particularly advantageous application, the cabinet units are adapted to be mounted on a wall in a modular array. A mounting bracket adapted to be secured to a wall is utilized together with at least two cabinet units adapted to be supported by the mounting bracket. With this arrangement, complementarily engagable hanger means support the cabinet units in side-by-side relation.

Preferably, the distinct orientations of the cabinet units are inverted positions thereof. This unique feature of the invention permitting selective orientation of the cabinet units is accomplished with oppositely facing slot means on each of the cabinet units and tab means on the mounting bracket which comprise the hanger means and are operable such that the tab means are selectively engageable with the slot means to support each of the cabinet units in either of the inverted positions thereof. Advantageously, the cabinet units include two pairs of slot means for this purpose.

In a preferred embodiment, each of the cabinet units includes a body portion substantially peripherally surrounded by a flange with at least the externally exposed portions of the flanges abutting a wall upon which the cabinet unit is mounted when the tab means are engaged with the slot means. The tab means can include a pair of spaced apart upstanding tabs disposed on the mounting bracket for each of the cabinet units with the slot means including at least one pair, and preferably two pairs, of spaced apart slotted bosses on each of the cabinet units adapted to receive a pair of the tabs therein. Moreover, the tabs are advantageously spaced from and generally parallel to a wall upon which the mounting bracket is secured such that the slotted bosses abut the wall when the tabs are received therein.

While not limited to such application, the cabinet system is well suited for use with cabinet units comprising substantially identical medicine cabinets. It will be appreciated that the medicine cabinets can each have a conventional mirrored door hinged to the flange surrounding the body portion thereof for pivotal movement to selectively provide access to the interior thereof. Preferably, the medicine cabinets are supported by the tabs and slotted bosses in abutting relation to give a substantially unitary, finished appearance to the cabinet system.

DETAILED DESCRIPTION OF THE PREFERRED EMBODIMENTS

Figure 1:
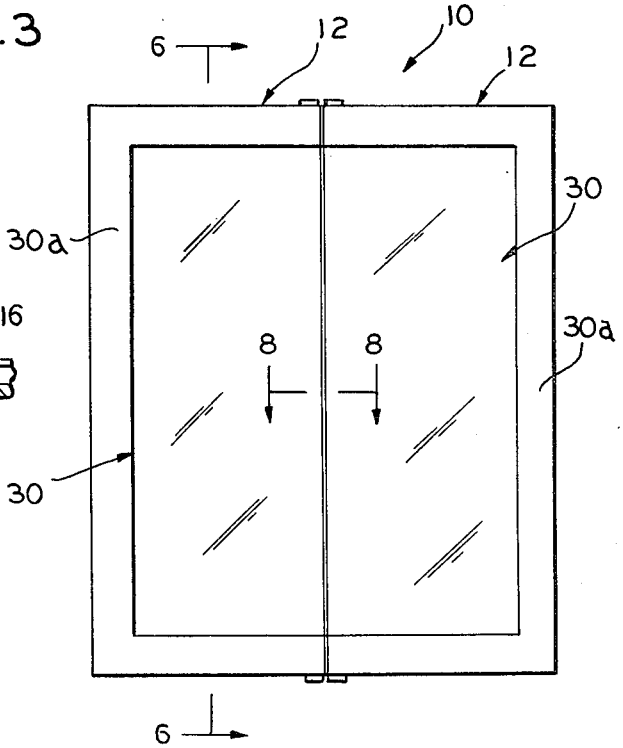
FIG. 1 is a front elevational view of a cabinet system in accordance with the present invention.

Referring to the drawings, and first to FIG. 1, the reference numeral 10 designates generally a modular wall mounted cabinet system in accordance with the present invention. The cabinet system 10 includes at least two cabinet units 12 which are substantially identical in construction together with means for mounting the cabinet units 12 on a wall, such as the mounting bracket 14 (see FIG. 5) which is adapted to be secured to a wall. Referring to the details illustrated in FIG. 5, the cabinet system 10 contemplates the cabinet units 12 and the mounting bracket 14 having complementarily engagable hanger means (described hereinafter).

With this arrangement, the cabinet units 12 are adapted to be supported in either of two distinct orientations in side-by-side relation. This is accomplished with the hanger means, which includes oppositely facing slot means such as slotted bosses 16 on each of the cabinet units 12 and tab means such as tabs 18 on the mounting bracket 14, preferably arranged such that the distinct orientations for the cabinet units 12 are inverted positions thereof. As will be appreciated, the tabs 18 are selectively engagable with the slotted bosses 16 to support each of the cabinet units 12 in either of the inverted positions thereof.

Figure 5:
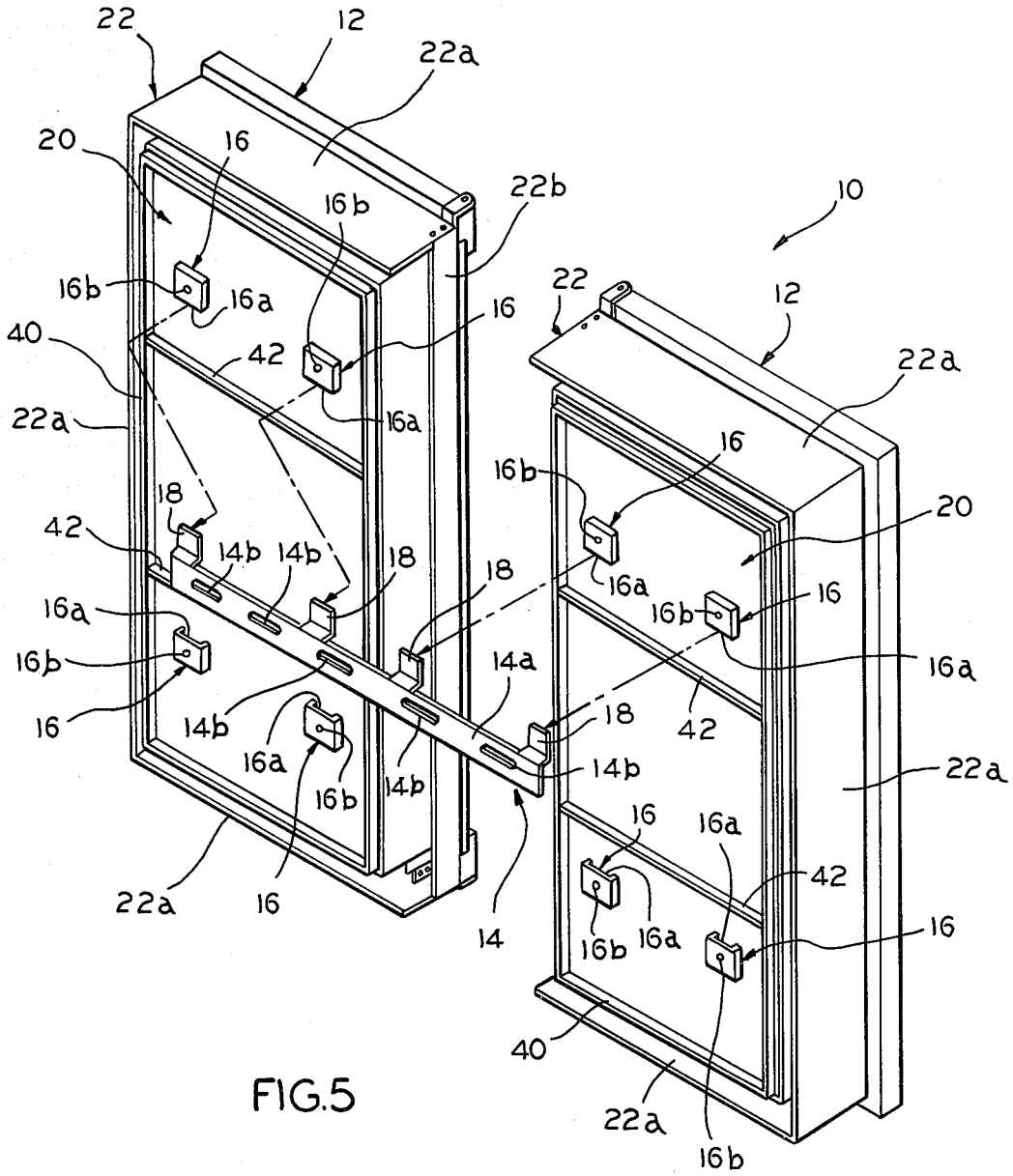
FIG. 5 is a partially exploded rear perspective view of the cabinet system shown in FIG. 1.

Still referring to FIG. 5, the mounting bracket 14 preferably includes a pair of spaced apart upstanding tabs 18 for each of the cabinet units. It will be seen that, since there are two cabinet units 12 in the embodiment illustrated in FIG. 5, there are two pairs of spaced apart upstanding tabs 18 disposed on the mounting bracket 14 and, in the event that it is desired to have a cabinet system with one or more additional cabinet units, the mounting bracket 14 can simply be extended so as to have an additional pair of tabs for each additional cabinet unit. Similarly, the cabinet units 12 each include at least one pair of spaced apart slotted bosses 16 adapted to receive a pair of the tabs 18 therein.

Referring specifically to the mounting bracket 14, it includes a fastener receiving portion **14*a* having a plurality of elongated slots 14*b* therein. The elongated slots 14*b* permit the mounting bracket 14 to be laterally adjustably positioned on a wall. Moreover, it is possible to drive screws into wall studs without drilling holes due to the large number of elongated slots 14*b***.

In the embodiment illustrated in the drawings, the cabinet units 12 are each provided with two pairs of spaced apart slotted bosses 16 both of which are adapted to receive a pair of the upstanding tabs 18 therein. The two pairs of slotted bosses preferably face one another in spaced apart relation such that the upper pair have downwardly facing slots **16*a* and the lower pair have upwardly facing slots 16*a*. With this arrangement, the cabinet units 12 are each adapted to be inverted so either of the pairs of slotted bosses 16** can be the upper pair thereof.

As will be appreciated, the pairs of upstanding tabs 18 register for sliding enagement with the downwardly facing slots **16*a* in the pairs of slotted bosses 16 comprising the upper pairs thereof. The slotted bosses 16 also include fastener receiving apertures 16*b* therein. With this arrangement, the apertures 16*b* in the lower pairs of slotted bosses are adapted to receive fasteners when the upstanding tabs 18 are engaged with the downwardly facing slots 16*a* in the upper pairs of slotted bosses in order to further secure the cabinet units 12** to a wall.

Figure 8:
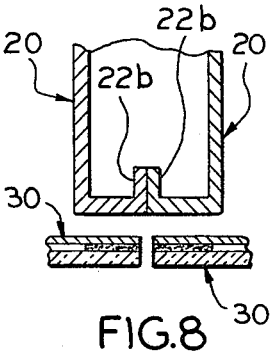
FIG. 8 is a cross-sectional view taken on the line 8—8 of FIGS. 1 and 3.

Referring to the detailed construction of the cabinet units 12, the cabinet units each include a body portion 20 substantially peripherally surrounded by a flange 22. Preferably, at least the externally exposed portions **22*a* of the flange 22 are of a width substantially the same as the depth of the cabinet units 12 so as to abut a wall upon which the cabinet units are mounted when the upstanding tabs 18 are disposed within the downwardly facing slots 16*a* in the slotted bosses 16 comprising the upper pairs thereof (see, for instance, FIGS. 5, 6 and 7), although it will be understood that the width of the flanges may be considerably less than the depth of the cabinet units, if desired, to reduce the manufacturing costs. Additionally, the cabinet units 12 are supported in abutting relationship such that the abutting sides have flange portions 22*b* of lesser width than the remainder of the flanges 22** (see, also, FIG. 8).

Figure 6:
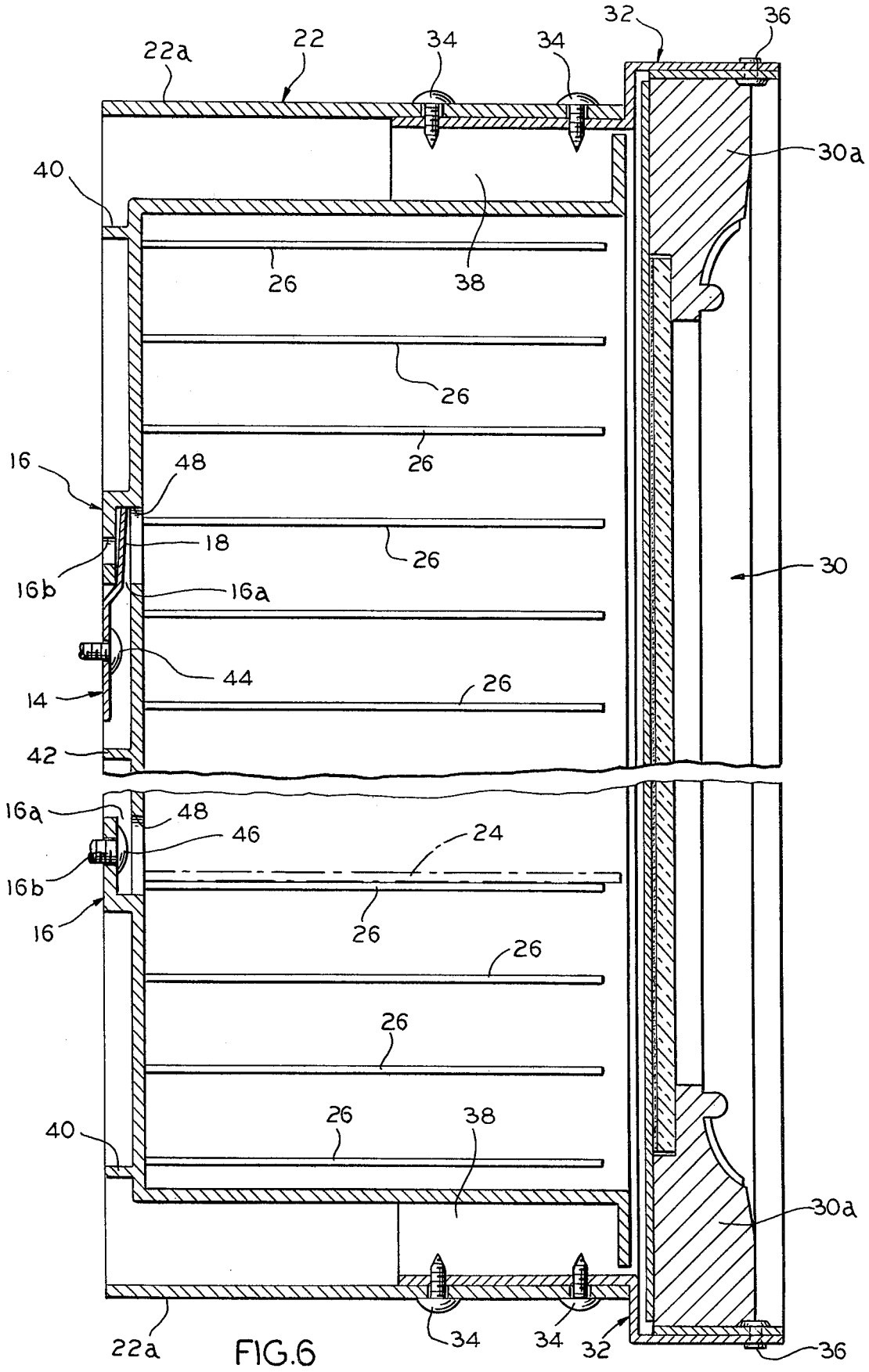
FIG. 6 is a cross-sectional view taken on line 6—6 of FIG. 1.

Referring to FIG. 6, it will be appreciated that the tabs 18 are spaced from and generally parallel to a wall upon which the mounting bracket 14 is secured such that the slotted bosses 16 abut the wall. This occurs as a result of the tabs 18 being received in the downwardly facing slots **16*a* in the upper pairs thereof (see, also, FIG. 7). Since the externally exposed portions 22*a* of the flanges 22 together with the slotted bosses 16 all abut the wall, the cabinet system 10** provides an attractively finished and securely mounted device in a modular array.

With this type of arrangement, the cabinet system 10 is particularly well suited for use as a medicine cabinet. For this type of application, and any other having similar requirements, each of the cabinet units 12 can advantageously include means for mounting at least one shelf 24 therein. In the embodiment illustrated in FIG. 6, the mounting means includes ledges 26 in each side of the body portion 20 permitting selectable adjustable positioning of the shelf 24 within the cabinet unit 12.

As will be appreciated, the ledges 26 permit the shelf 24 to be supported in either of the inverted positions of the cabinet unit 12. It will also be appreciated that, in practice, a plurality of ledges 26 can be molded in the sides of the body portion 20, and it is usually desirable to provide a plurality of shelves (such as 24) with a sufficient number of ledges 26 being provided to support the desired number of shelves while, at the same time, permitting the spacing between shelves to be varied. Of course, many other arrangements for mounting shelves within the cabinet units 12 are also available for use with the present invention.

As shown, the cabinet units 12 comprise substantially identical medicine cabinets. The medicine cabinets each have a mirrored door 30 joined to the flange 22 by means of hinges 32 for standard pivotal door opening and closing movement to selectively provide access to the interior or body portion 20 thereof. While not specifically shown, the medicine cabinets 12 each preferably include means for maintaining the mirrored door 30 in a closed position such as a magnetic catch or the like.

Referring to FIG. 6, additional details of the present invention can be understood. The hinges 32 are suitably fastened to the flange 22 by means of fasteners 34. It will also be seen that hinge pins 36 permit the pivotal movement of the mirrored door 30 by joining the portion of the hinges 32 secured to door frame 30*a* to the portion of the hinges attached to the flange 22 at or near the front of the frame 30*a*. With this cantilever hinge type of arrangement, the cabinet unit 12 is preferably provided with reinforcing ribs 38 extending between the flange 22 and the body portion 20 adjacent the point where the hinges 32 are secured to the flange 22 by means of the fasteners 34.

Additional strengthening may be achieved by utilizing a peripherally extending reinforcing rib 40 and one or more laterally extending reinforcing ribs 42 on the back of the body portion 20 (FIG. 5). This is particularly advantageous where the cabinet unit 12 is primarily constructed of lightweight molded plastic, and it will be appreciated that the ribs 40 and 42 can advantageously be dimensioned to abut against a wall when the cabinet unit 12 is mounted on a wall in accordance with the teachings of the present invention to provide additional rigidity to the entire cabinet system 10. Moreover, while not shown, the flange portion 22*a* can be provided with reinforcing ribs at the edges adjacent the flange portion 22*b* for still additional strengthening.

Figure 2:
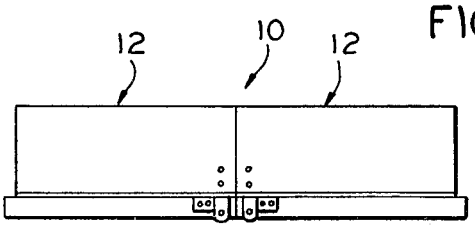
FIG. 2 is a top plan view of the cabinet system shown in FIG. 1.

Referring to FIGS. 1 and 2, the cabinet system 10 is illustrated in an application using two cabinet units 12. The two cabinet units 12 are identical in construction and differ only in that one of the cabinet units is inverted relative to the other of the cabinet units which is made possible by the present invention. It will be seen by referring to FIG. 6 that the mounting bracket 14 is secured to a wall by means of fasteners (such as fastener 44) with the tabs 18 inserted into the downwardly facing slots 16*a* in the upper pairs of slotted bosses 16. The cabinet units 12 can be virtually assured of a level mounting by reason of the fact that it is relatively simple to fasten the mounting bracket 14 in a level position on a wall. After the cabinet units have been hung on the mounting bracket (as shown, for instance, in FIG. 6), they are further secured to the wall by means of fasteners 46 that may be inserted through the apertures 16*b* in the lower pairs of slotted bosses 16 which are accessible through openings 48 in the rear of the body portions 20 of the cabinet units 12.

As shown in FIG. 1, the cabinet units 12 each include a decorative frame 30*a* extending about the three sides thereof comprising a portion of the outer periphery of the cabinet system 10. The fourth sides of the cabinet units 12, which are the sides thereof having the narrow flange portions 22*b* held in abutment when the cabinet units 12 are mounted on a wall, do not include frame portions but, rather, are defined by exposed mirror edges of the mirrored doors 30. As will be appreciated, the cabinet units 12 are designed so as to provide a slight spacing between the mirrored doors 30 (see FIGS. 7 and 8) in order to accommodate relative opening and closing movement without damaging the exposed mirror edges.

Figure 4:
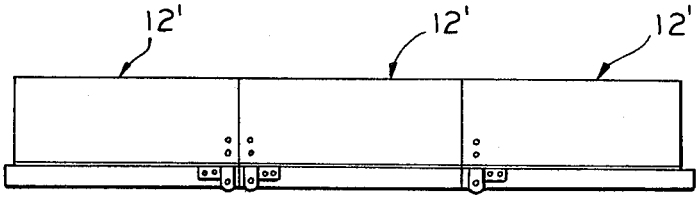
FIG. 4 is a top plan view of the cabinet system shown in FIG. 3.
Figure 3:
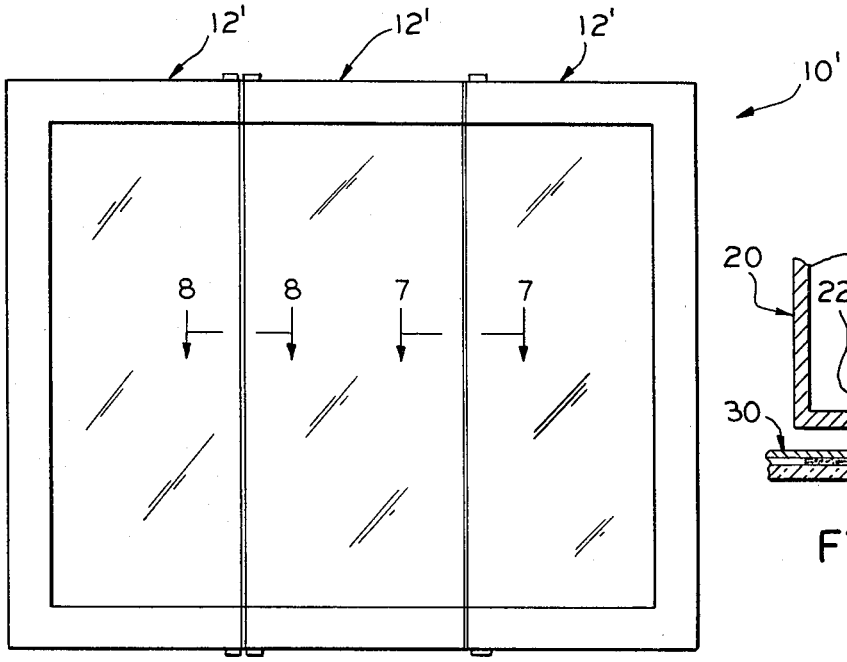
FIG. 3 is a front elevational view of an alternative embodiment of cabinet system in accordance with the present invention.

Referring now to FIGS. 3 and 4, cabinet system 10' is illustrated in an application using three cabinet units 12'. It will be seen and appreciated from FIGS. 3 and 4 as well as FIGS. 7 and 8 that all of the cabinet units 12' are identical with the sole exception that the decorative frame on the center cabinet unit extends only across the top and bottom. As will be appreciated, the center cabinet unit 12' must differ in this respect in the event that it is desired to provide the cabinet system 10' with a decorative frame extending peripherally completely thereabout.

If the doors on the cabinet units 12' are completely mirror covered, or have a decorative frame only on the top and bottom edges, the cabinet units 12' can be entirely identical in every respect. This will provide economies in manufacture and distribution permitting the use of as many cabinet units as desired, for instance, to cover the entire length of a wall, and, since only one side of each cabinet unit has a narrow flange portion, i.e., the side on which the hinges are mounted, it is possible to turn the narrow flange portions inwardly on the end cabinet units so as to provide a substantially continuous external peripherally extending flange for the cabinet system abutting the wall upon which the individual cabinet units are mounted. Moreover, even if it is desired to provide the frame as illustrated in FIG. 3, the cabinet system 10' can be provided with as many cabinet units as needed for a particular application by providing only two very slightly different types of cabinet units differing only in the construction of the frame on the mirrored door.

With a framed cabinet system, the end cabinet units are identical in every respect for both two and three door cabinets. The end units become right or left-hand units simply by inverting them relative to one another such that the frame extends peripherally about the entire cabinet system. Moreover, the center cabinet units have an identical body to the end units with only slightly different doors.

Figure 7:
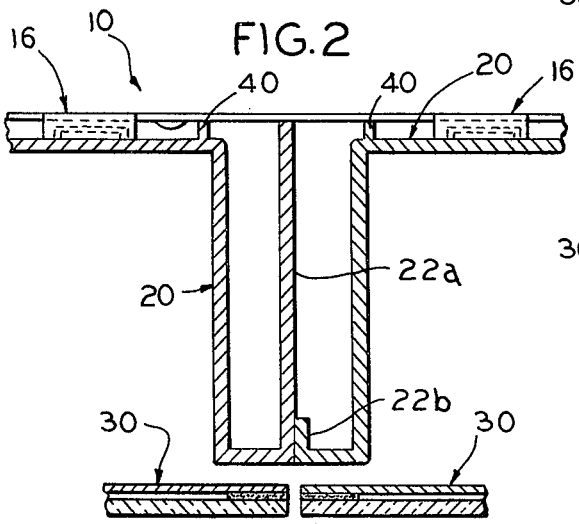
FIG. 7 is a cross-sectional view taken on the line 7—7 of FIG. 3.

While difficult to detect in the drawings, the flanges preferably have a very slight outward draft on the order of one-half degree. It is principally for this reason that the flange portion 22*b* are provided along one side so that it is possible to minimize or substantially eliminate any gap at the joints between the body portions that would otherwise be caused by the draft on the side flanges. With this arrangement, a wide flange portion need never abut another wide flange portion but can always abut a narrow flange portion as shown in FIG. 7.

While the cabinet system has been described in detail in connection with applications using two or three cabinet units, it will be appreciated that the system can be utilized with a single cabinet as well. The advantage in this type of arrangement for a single cabinet application is that the cabinet can be mounted to open from the right-hand or left-hand side without specifically selecting a particular cabinet pre-hinged so as to open from the desired side. Moreover, a system utilizing a single cabinet could advantageously be provided without a flange or with a flange extending completely about the cabinet, as desired.

With the mounting arrangement of the present invention, a variety of advantages are obtained. It is possible to manufacture a single type of cabinet unit capable of use in a modular arrangement. Also, the mounting means permits easier installation since it is relatively easy to fasten the mounting bracket to a wall in a level position during installation. It is also possible to taper the tabs on the mounting bracket slightly in a fashion which forces the cabinet units together as the tabs are seated in the slots in the slotted bosses. Additionally, many other important advantages are inherent in the description of the invention throughout.

Various changes coming within the spirit of the present invention may suggest themselves to those skilled in the art. Hence, it will be understood that the invention is not to be limited to the specific embodiments shown and described or the uses mentioned. On the contrary, the specific embodiments and uses are intended to be merely exemplary with the present invention being limited only by the true spirit and scope of the appended claims.

I claim:

1. A modular wall mounted cabinet system, comprising:

a mounting bracket adapted to be secured to a wall; and at least two cabinet units adapted to be supported by said bracket;

said cabinet units and mounting bracket having complementarily engageable hanger means, said hanger means being adapted to support each of said cabinet units in either of two distinct orientations, said cabinet units being supported by said hanger means in side-by-side relation, said distinct orientations for said cabinet units being inverted positions, said hanger means including oppositely facing slot means on each of said cabinet units and tab means on said mounting bracket, said tab means being selectively engageable with said slot means to support each of said cabinet units in either of said inverted positions.

2. The modular wall mounted cabinet system as defined in claim 1 wherein said tab means includes a pair of spaced apart upstanding tabs for each of said cabinet units, said tabs being disposed on said mounting bracket, said slot means including at least one pair of spaced apart slotted bosses on each of said cabinet units adapted to receive a pair of said tabs therein.

3. The modular wall mounted cabinet system as defined in claim 1 wherein said mounting bracket includes a fastener receiving portion having a plurality of elongated slots, said elongated slots permitting said mounting bracket to be laterally adjustably positioned on said wall.

4. The modular wall mounted cabinet system as defined in claim 2 wherein said slot means includes a second pair of spaced apart slotted bosses on each of said cabinet units adapted to receive a pair of said tabs therein, said second pairs of slotted bosses facing said first pairs of slotted bosses in spaced apart relation, the upper pairs of said slotted bosses having downwardly facing slots therein.

5. The modular wall mounted cabinet system as defined in claim 4 wherein each of said cabinet units is adapted to be inverted so either of said pairs of slotted bosses can be the upper pair thereof, said pairs of tabs registering for sliding engagement with said downwardly facing slots in said pairs of slotted bosses comprising the upper pairs thereof.

6. The modular wall mounted cabinet system as defined in claim 5 wherein said slotted bosses include fastener receiving apertures therein, said apertures in said pairs of slotted bosses comprising the lower pairs thereof being adapted to receive fasteners when said tabs are engaged with said downwardly facing slots in said pairs of slotted bosses comprising the upper pairs thereof.

7. The modular wall mounted cabinet system as defined in claim 1 wherein each of said cabinet units includes means for mounting at least one shelf therein, said shelf mounting means being adapted to support said shelf in either of said inverted positions of said cabinet unit.

8. The modular wall mounted cabinet system as defined in claim 7 wherein said shelf mounting means permits selective adjustable positioning of said shelf within said cabinet unit.

9. The modular wall mounted cabinet system as defined in claim 1 wherein each of said cabinet units includes a body portion substantially peripherally surrounded by a flange, at least the externally exposed portions of said flanges abutting a wall upon which said cabinet units are mounted when said tab means are engaged with said slot means.

10. The modular wall mounted cabinet system as defined in claim 9 wherein said tab means includes a pair of spaced apart upstanding tabs for each of said cabinet units, said tabs being diposed on said mounting bracket, said slot means including at least one pair of spaced apart slotted bosses on each of said cabinet units adapted to receive a pair of said tabs therein.

11. The modular wall mounted cabinet system as defined in claim 10 wherein said tabs are spaced from and generally parallel to a wall upon which said mounting bracket is secured, said slotted bosses abutting a wall upon which said cabinet units are mounted when said tabs are received in said slotted bosses.

12. The modular wall mounted cabinet system as defined in claim 11 wherein said cabinet units comprise substantially identical medicine cabinets, said medicine cabinets each having a mirrored door hinged to said flange for pivotal movement to selectively provide access to the interior thereof.

13. The modular wall mounted cabinet system as defined in claim 12 wherein said medicine cabinets are supported by said tabs and slotted bosses in abutting relation, the sides of said medicine cabinets in abutting relation having flanged portions of lesser width than the remainder of said flanged portions.

14. The modular wall mounted cabinet system as defined in claim 13 wherein said cabinet units include a third medicine cabinet, said mounting bracket having disposed thereon three pairs of spaced apart upstanding tabs, said third medicine cabinet being disposed between the other two of said medicine cabinets in abutting relationship thereto.

* * * * *